US005419996A

United States Patent [19]

Naruse et al.

[11] Patent Number: 5,419,996

[45] Date of Patent: May 30, 1995

[54] COLOR DIFFUSION TRANSFER PHOTOSENSITIVE MATERIAL

[75] Inventors: Hideaki Naruse; Nobuo Seto; Masakazu Morigaki; Masayuki Negoro, all of Kanagawa, Japan

[73] Assignee: Fuji Photo Film Co., Ltd., Kanagawa, Japan

[21] Appl. No.: 214,231

[22] Filed: Mar. 17, 1994

[30] Foreign Application Priority Data

Mar. 18, 1993 [JP] Japan ..... 5-082403

[51] Int. Cl.[6] ..... G03C 8/10; G03C 8/56

[52] U.S. Cl. ..... 430/214; 430/213; 430/216; 430/941

[58] Field of Search ..... 430/214, 213, 216, 218

[56] References Cited

U.S. PATENT DOCUMENTS

| | | | |
|---|---|---|---|
| 3,930,864 | 1/1976 | Abel et al. | 430/213 |
| 4,069,048 | 1/1978 | Tsubota et al. | 430/214 |
| 4,374,919 | 2/1983 | Toriuchi | 430/214 |
| 4,474,854 | 10/1984 | Bergthaller et al. | 430/214 |
| 4,741,980 | 5/1988 | Kaneko | 430/216 |
| 5,112,720 | 5/1992 | Karino | 430/214 |
| 5,194,361 | 3/1993 | Taguchi | 430/214 |

*Primary Examiner*—Richard L. Schilling
*Attorney, Agent, or Firm*—Sughrue, Mion, Zinn, Macpeak & Seas

[57] ABSTRACT

Disclosed is a color diffusion transfer photosensitive material containing a compound represented by a color diffusion transfer photosensitive material containing at least one compound represented by the following general formula (I):

(I)

wherein $R_1$ and $R_2$ each represent a hydrogen atom, an aliphatic group or an aryl group; and $R_3$ represents an aliphatic group or a group represented by the following general formula (Ab):

(Ab)

wherein $R_4$ represents a hydrogen atom, an aliphatic group or an aryl group and $R_5$ represents an aliphatic group, an aryl group or an amino group; and further, $R_1$ and $R_2$, $R_1$ and $R_3$, $R_2$ and $R_3$, or $R_4$ and $R_5$ may combine with each other to form a 5- to 7-membered ring, or $R_1$, $R_2$ and $R_3$ may combine with one another to form a bicyclo ring; wherein the total number of carbon atoms contained in $R_1$, $R_2$ and $R_3$ is not smaller than 10, at least either $R_1$ or $R_2$ is an aliphatic group, and $R_3$ is a group represented by general formula (Ab) when one of the groups $R_1$ and $R_2$ is an aliphatic group and the other is an aryl group.

4 Claims, No Drawings

COLOR DIFFUSION TRANSFER PHOTOSENSITIVE MATERIAL

FIELD OF THE INVENTION

The present invention relates to a color diffusion transfer photosensitive material and, more particularly, to a photosensitive material in which the final image formed is materially reduced in density increase with the lapse of time.

BACKGROUND OF THE INVENTION

Conventional color diffusion transfer photosensitive materials are classified into two groups by film unit structure as of peel-apart type and no peel-apart type. In a photosensitive material of the peel-apart type, a light-sensitive layer unit and a dye image-receiving layer unit are coated on separate supports, and its photosensitive and image-receiving elements are brought into face-to-face contact with each other after imagewise exposure. Then, a processing solution is spread between those elements, and thereafter is peeled apart the dye image-receiving element. Thus, dye images transferred to the dye image-receiving layer are obtained.

However, the material of the above-described type has a problem such that, when the dye image-receiving element is delaminated after the prescribed time (exceeding the time at which the image formation is completed), dyes remaining in the photosensitive element are further transferred to cause color balance loss, stains on the white background and so on.

As for the photosensitive materials of no peel-apart type, on the other hand, a dye image-receiving layer and silver halide emulsion layers are sandwiched between a transparent support and another support. In one structure, those layers all are coated on the transparent support; while in another structure the dye image-receiving layer is coated on the transparent support and the emulsion layers are coated on the other support. Further, in order to view dye images transferred to the image-receiving layer by reflected light, the former structure is designed so as to have a white light-reflecting layer between the image-receiving layer and the emulsion layer unit, and the latter structure is designed so that a processing composition containing a white pigment can be spread between the image-receiving layer and the silver halide emulsion layer unit.

However, the photosensitive materials of the no peel-apart type suffer an appreciable change in image density with the lapse of time, because it takes a good long time for the dyes released from the silver halide emulsion layers to finish fixing to the image-receiving layer. In this respect, it is desirable for them to undergo a decided improvement.

As a means of solving the above-described problems, there are disclosed a method of providing a dye-capturing layer, which comprises a quaternary salt type polymer latex, as the outermost layer of a transparent cover sheet in JP-A-3-53248 (the term "JP-A" as used herein means an "unexamined published Japanese patent application"), an art of providing a dye-capturing layer inside a timing layer or on the base side of a timing layer in U.S. Pat. No. 3,930,864, and an art of providing a dye-capturing layer between an image-receiving layer and a dye-producing layer in U.K. Patent 1,537,079.

However, such methods cannot accomplish sufficient effects. In addition, they have a problem of causing a decrease in transferred image density. Thus, arts of preventing the transferred image density from changing with the lapse of time without accompanied with a drop in transferred image density are desirable to be developed.

SUMMARY OF THE INVENTION

Therefore, an object of the present invention is to inhibit the density of a transferred image from changing after a time defined as a completion time of the image formation without accompanied with a drop in initial transferred density of the image.

It has now been found out that the above-described object can be attained with color diffusion transfer photosensitive materials (1) and (2) described below.

That is, there is provided a color diffusion transfer photosensitive material (1) which contains at least one compound represented by the following general formula (I):

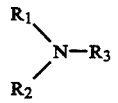

(I)

wherein $R_1$ and $R_2$ each represent a hydrogen atom, an aliphatic group or an aryl group; and $R_3$ represents an aliphatic group or a group represented by the following general formula (Ab):

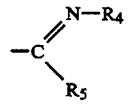

(Ab)

wherein $R_4$ represents a hydrogen atom, an aliphatic group or an aryl group and $R_5$ represents an aliphatic group, an aryl group or an amino group; and further, $R_1$ and $R_2$, $R_1$ and $R_3$, $R_2$ and $R_3$, or $R_4$ and $R_5$ may combine with each other to form a 5- to 7-membered ring, or $R_1$, $R_2$ and $R_3$ may combine with one another to form a bicyclo ring; provided that the total number of carbon atoms contained in $R_1$, $R_2$ and $R_3$ is not smaller than 10, at least either $R_1$ or $R_2$ is an aliphatic group, and $R_3$ is a group represented by general formula (Ab) when one of the groups $R_1$ and $R_2$ is an aliphatic group and the other is an aryl group.

As another embodiment, there is provided a color diffusion transfer photosensitive material (2) which not only contains the foregoing compound but also has (A) a film unit structure constituted of (i) a photosensitive sheet comprising a transparent support having thereon an image-receiving layer, a light-reflecting white layer, a light-shielding layer and at least one silver halide emulsion layer having associated therewith at least one dye image-forming substance, (ii) a transparent cover sheet comprising a transparent support having thereon at least a neutralizing layer and a neutralization timing layer, and (iii) a light-shielding alkaline processing composition arranged so as to be spread between the foregoing photosensitive and transparent cover sheets: or (B) a film unit structure constituted of (i) an image-receiving sheet comprising a support having thereon, in sequence, a neutralizing layer, a neutralization timing layer, an image-receiving layer and a releasable layer, (ii) a photosensitive sheet comprising a support provided with a light-shielding layer having thereon at least one silver halide emulsion layer having associated therewith at least one dye image-forming substance, and (iii) an alkaline processing composition to be spread between the foregoing image-receiving end photosensitive sheets.

DETAILED DESCRIPTION OF THE INVENTION

The compounds of the present invention are described below in detail.

The term "aliphatic group" used in describing the compounds of the present invention is intended to include saturated and unsaturated ones which may have any of straight-chain, branched and cyclic structures. For instance, it includes an alkyl, alkenyl, cycloalkyl or cycloalkenyl group, which may further have a substituent.

The term "heterocyclic ring" used in describing the compounds of the present invention refers to the ring which contains at least one hetero atom as ring member, including aromatic rings. Further, such rings may have a substituent.

The term "substituent" in the description of the present compounds is intended to include any of groups capable of being substituted. For instance, it includes an aliphatic group, an aryl group, a heterocyclic group, an acyl group, an acyloxy group, an acylamino group, an aliphatic oxy group, an aryloxy group, a heterocyclic oxy group, an aliphatic oxycarbonyl group, an aryloxycarbonyl group, a heterocyclic oxycarbonyl group, a carbamoyl group, an aliphatic sulfonyl group, an arylsulfonyl group, an aliphatic sulfonyloxy group, an arylsulfonyloxy group, a sulfamoyl group, an aliphatic sulfonamido group, an arylsulfonamido group, an amino group, an aliphatic amino group, an aromatic amino group, an aliphatic oxycarbonylamino group, an aromatic oxycarbonylamino group, an aliphatic sulfinyl group, an arylsulfinyl group, an aliphatic thio group, an arylthio group, a mercapto group, a hydroxy group, a cyano group, a nitro group, a sulfo group, a hydroxyamino group, an aliphatic oxyamino group, an aryloxyamino group, a carbamoylamino group, a sulfamoylamino group, a halogen atom, a sulfamoylcarbamoyl group, a carbamoylsulfamoyl group, and so on.

Now, the general formula (I) is described in detail.

$R_1$and $R_2$ each represent a hydrogen atom, an aliphatic group (preferably an alkyl or alkenyl group which contains 1 to 40 carbon atoms, preferably 6 to 20 carbon atoms, which may have a substituent, e.g., methyl, ethyl, i-propyl, t-butyl, dodecyl, 4-(2,4-di-t-pentylphenoxy)butyl, 3-(3-dodecyloxyphenylcarbamoyl)propyl, 2-hexyldecyl, cyclohexyl, 2-phenetyl, benzyl, 3-dioctylaminopropyl, allyl, 8-octadecenyl), or an aryl group (preferably a phenyl group which contains 6 to 36 carbon atoms, preferably 6 to 20 carbon atoms, which may have a substituent, e.g., phenyl, 4-dodecyloxyphenyl, 3-chlorophenyl).

$R_3$ represents an aliphatic group (preferably an alkyl or alkenyl group which contains 1 to 40 carbon atoms, preferably 6 to 20 carbon atoms, which may have a substituent, i.e., methyl, ethyl, i-propyl, t-butyl, dodecyl, 4-(2,4-di-t-pentylphenoxy)butyl, 3-(3-dodecyloxyphenylcarbamoyl)propyl, 2-hexyldecyl, cyclohexyl, 2-phenetyl, benzyl, allyl, 8-octadecenyl) or a group represented by formula (Ab).

$R_4$ represents a hydrogen atom, an aliphatic group (preferably an alkyl or alkenyl group which contains 1 to 40 carbon atoms, preferably 6 to 20 carbon atoms, which may have a substituent, e.g., methyl, ethyl, i-propyl, t-butyl, dodecyl, 4-(2,4-di-t-pentylphenoxy)butyl, 3-(3-dodecyloxyphenylcarbamoyl)propyl, 2-hexyldecyl, cyclohexyl, 2-phenetyl, benzyl, 3-dioctylaminopropyl, allyl, 8-octadecenyl), or an aryl group (preferably a phenyl group which contains 6 to 36 carbons atoms, preferably 6 to 20 carbon atoms, which may have a substituent, e.g., phenyl, 4-dodecyloxyphenyl, 3-chlorophenyl).

$R_5$ represents an aliphatic group (preferably an alkyl or alkenyl group which contains 1 to 40 carbon atoms, preferably 6 to 20 carbon atoms, which may have a substituent, e.g., methyl, ethyl, i-propyl, t-butyl, dodecyl, 4-(2,4-di-t-pentylphenoxy)butyl, 3-(3-dodecyloxyphenylcarbamoyl)propyl, 2-hexyldecyl, cyclohexyl, 2-phenetyl, benzyl, 3-dioctylaminopropyl, allyl, 8-octadecenyl), an aryl group (preferably a phenyl group which contains 6 to 36 carbon atoms, preferably 6 to 20 carbon atoms, which may have a substituent, e.g., phenyl, 4-dodecyloxyphenyl, 3-chlorophenyl), or an amino group (preferably an amino group which contains 1 to 50 carbon atoms, preferably 6 to 20 carbon atoms, which may have substituents, and which may form a cyclic ring in case two substituents are present on the nitrogen atom (i.e., N,N-disubstituent) and they are bonded to each other, e.g., anilino, dioctylamino, N-ethylanilino, piperidyl).

Further, $R_1$ and $R_2$, $R_1$and $R_3$, $R_2$ and $R_3$, or $R_4$ and $R_5$ may combine with each other to form a 5- to 7-membered ring (e.g., a piperazine ring, a piperidine ring, a pyrrolidine ring, a homopiperazine ring). Also, the three substituents, $R_1$, $R_2$ and $R_3$, may combine with one another to form a bicyclo ring (e.g., a bicyclo[2,2,-2]octane ring).

The total number of the carbon atoms contained in $R_1$, $R_2$ and $R_3$ is not smaller than 10, and at least either $R_1$ or $R_2$ is an aliphatic group. Further, $R_3$ is a group represented by formula (Ab) when one of the groups $R_1$ and $R_2$ is an aliphatic group and the other is an aryl group.

For making the present invention fully efficient, it is desirable that $R_1$ and $R_2$ be an aliphatic group, preferably an alkyl or alkenyl group. Further, it is to be desired that the total number of the carbon atoms contained in $R_1$, $R_2$ and $R_3$ be not smaller than 18, preferably in the range of 20 to 80.

As for the substituents by which the aliphatic groups representing $R_1$ to $R_5$ may be Substituted, a carbamoyl group, an alkoxy group, an aryloxy group, an aryl group, a sulfonyl group, an acylamino group, an alkylamino group and a heterocyclic group are preferred because these groups can have better effect on the present invention.

Specific examples of the compounds represented by general formula (I) are illustrated below. However, the invention should not be construed as being limited to these examples.

(1)
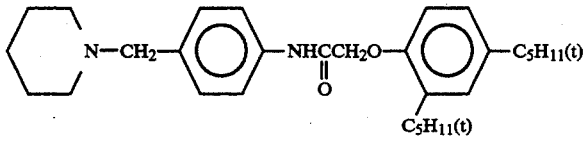
(2)
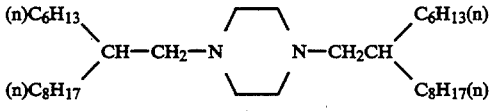
(3)
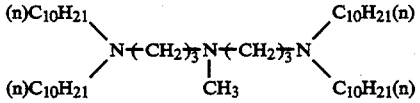
(4)
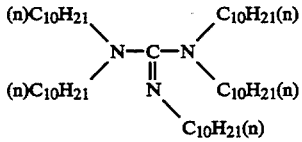
(5)
$((n)C_8H_{17})_3N$
(6)
$((n)C_{12}H_{25})_3N$
(7)
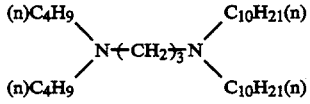
(8)
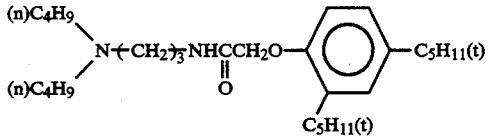
(9)
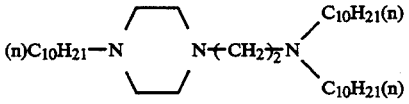
(10)
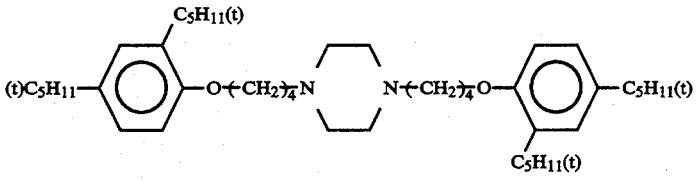
(11)
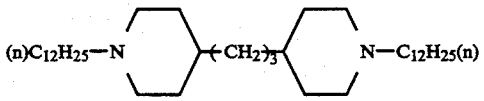
(12)
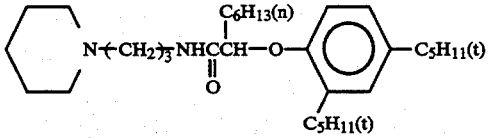
(13)
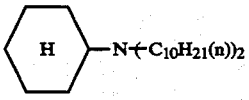

-continued
(14)
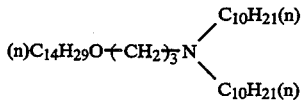
(15)
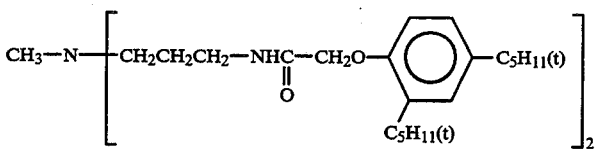
(16)
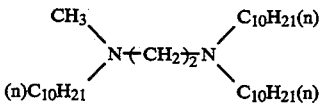
(17)
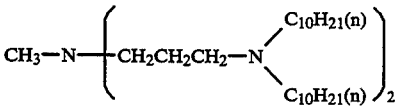
(18)
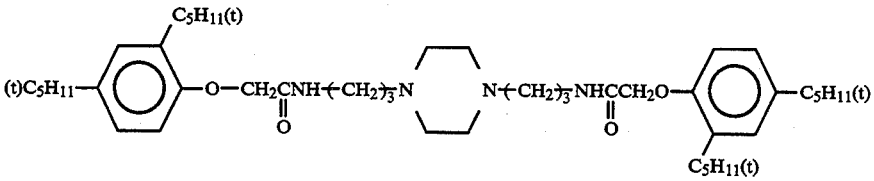
(19)
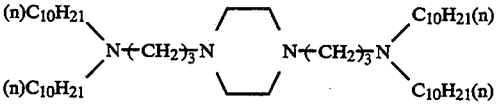
(20)
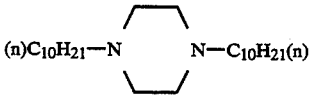
(21)
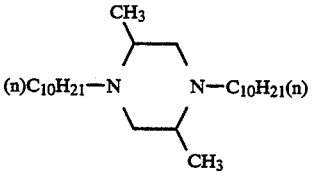
(22)
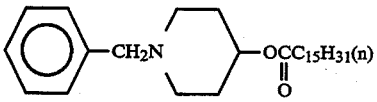
(23)
$(CH_3\text{-}(CH_2)_7CH{=}CH\text{-}(CH_2)_8)_2N\text{-}C_{18}H_{37}$
(24)
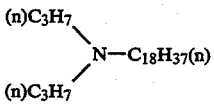
(25)
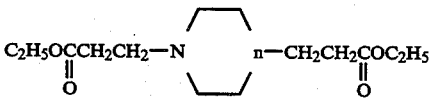
(26)
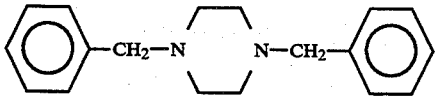

-continued
(27)
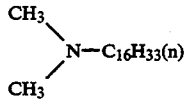
(28)
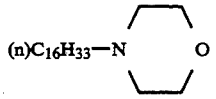
(29)
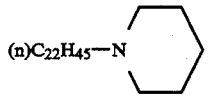
(30)
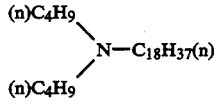
(31)
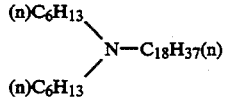
(32)
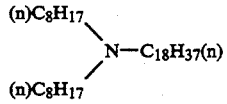
(33)
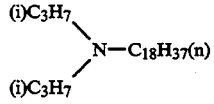
(34)
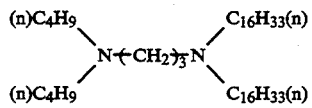
(35)
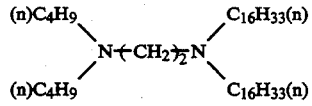
(36)
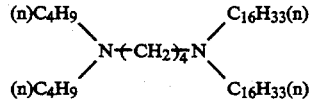
(37)
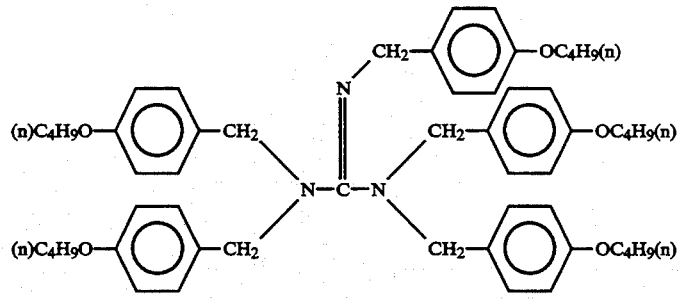

-continued
(38)
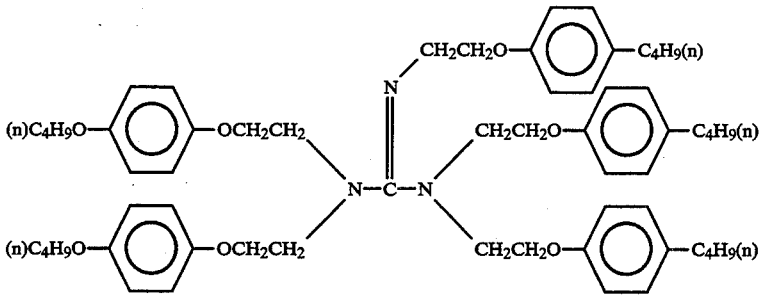
(39)
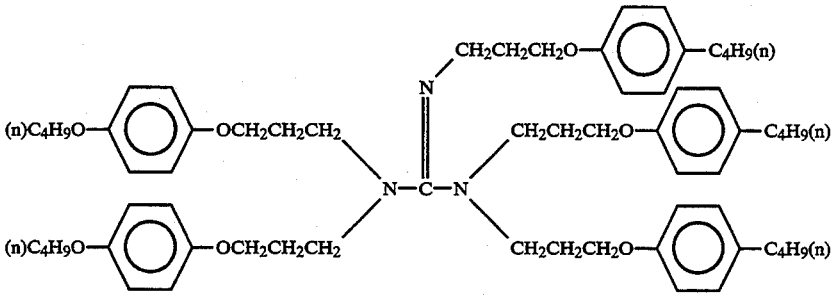
(40)
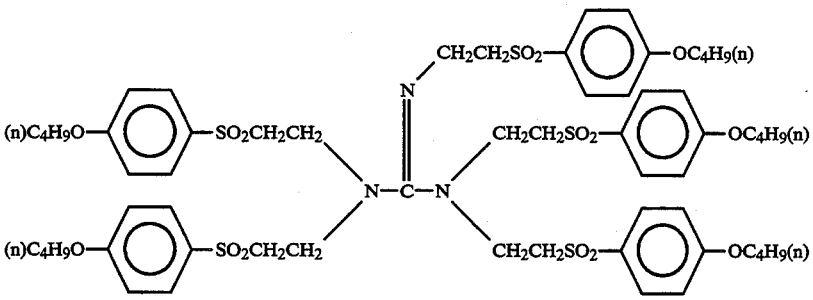
(41)
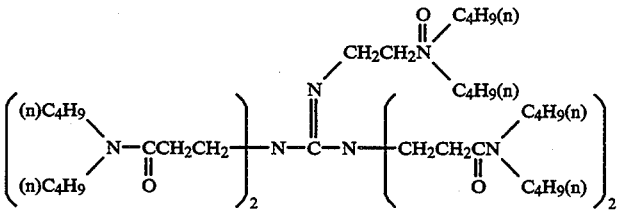
(42)
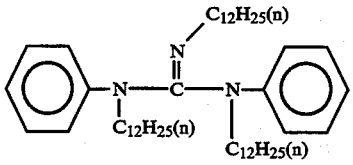
(43)
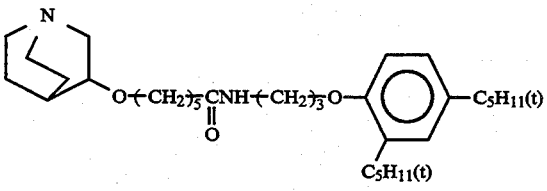

-continued
(44)
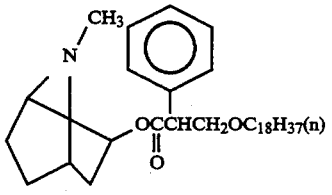
(45)
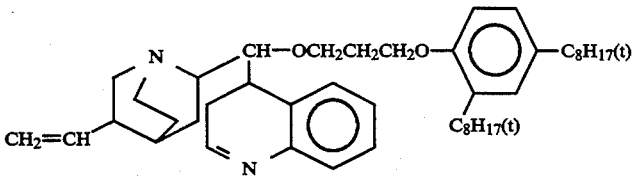
(46)
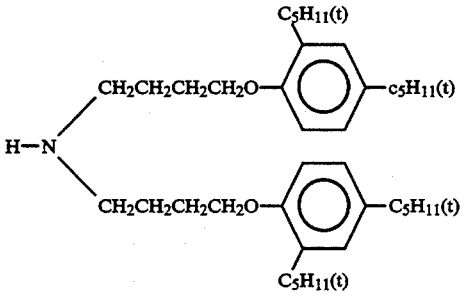
(47)
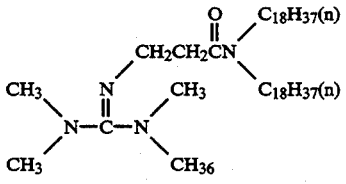
(48)
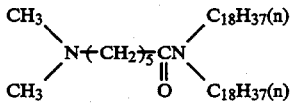
(49)
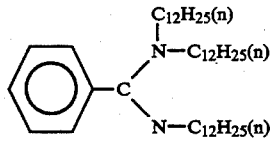
(50)
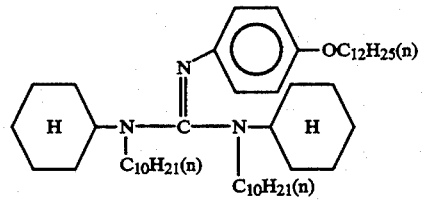
(51)
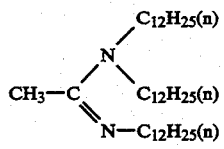

-continued (52)

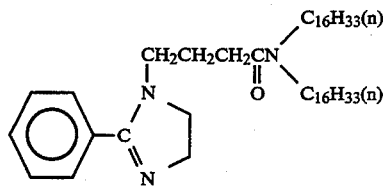

(53)

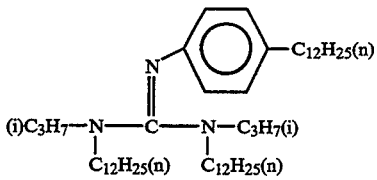

(54)

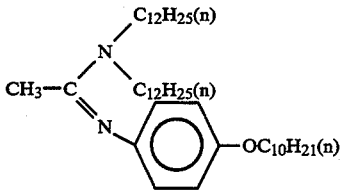

(55)

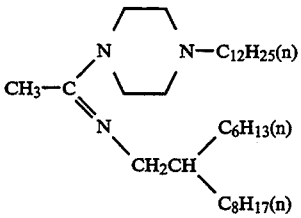

(56)

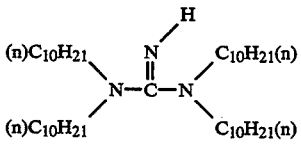

These compounds can be synthesized by the reaction of primary or secondary amines with alkyl halides, by reduction of amide compounds, or according to the methods described in a book entitled "Shin-Jikken Kagaku Koza" (which means new lectures on experimental chemistry), volume 14–3, page 1608 (1978).

Syntheses of typical representative compounds are specifically described below. Synthesis of Exemplified Compound (2):

40 ml of thionyl chloride was added to 41.0 g of 2-hexyldecanic acid, and heated under reflux for 1 hour. After excess thionyl chloride was distilled away under reduced pressure, 6.8 g of piperazine, 50 ml of dimethylacetamide, 100 ml of ethyl acetate and 25 ml of triethylamine were added dropwise over a 10-minute period with stirring at 10°–20° C. The resulting solution was poured into 200 ml of cold water, and then extracted with 100 ml of ethyl acetate. The ethyl acetate layer was washed with 200 ml each of saturated brine for two times, and dried over anhydrous magnesium sulfate. Therefrom, the solvent was distilled away. The thus obtained oily matter was purified by silica gel column chromatography to give 41.0 g of the oily matter as the intermediate.

2.4 g of lithium aluminum hydride was added to 20 ml of teterahydrofuran, and stirred at 15°–20° C. Thereinto, a 11.2 g portion of the oily matter was dropped over a 5-minute period. The heating and stirring of the reaction mixture was continued for additional 30 minutes. Then, the temperature inside the reaction system was lowered to 25°–30° C. Thereinto, 20 ml of ethyl acetate and 50 ml of water were dropped slowly. The reaction mixture thus obtained was extracted with 100 ml of ethyl acetate. The ethyl acetate layer was washed with 100 ml of saturated brine, and dried over anhydrous magnesium sulfate. Therefrom, the solvent was distilled away under reduced pressure. The thus obtained oily matter was purified by alumina column chromatography to give a white viscous liquid.

This liquid was identified as Exemplified Compound (2) by measuring its mass spectrum, NMR spectrum and IR spectrum respectively. The amount of the liquid obtained was 8.9 g, and the yield thereof was 83.6% (based on the oily intermediate).

The present compounds represented by general formula (I) are preferably used in an amount of 0.3 to 10 g/m$^2$, particularly 0.5 to 5 g/m$^2$.

The present compounds may be incorporated in any of (1) a photosensitive sheet, (2) an image-receiving sheet and (3) a cover sheet. These sheets are described in detail hereinafter.

In other words, the present compounds can be incorporated in any of constituent layers of a light-sensitive material. In case of light-sensitive materials of the no peel-apart type, however, it is desirable that the present compounds be incorporated in (i) the uppermost layer of a transparent cover sheet, (ii) a layer arranged between a dye-producing layer and an image-receiving layer or (iii) a layer other than the layer(s) arranged between a dye-producing layer and an image-receiving layer. In particular, the last case (iii) is preferred.

In case of light-sensitive materials of the peel-apart type, it is desirable that the present compounds be incorporated in (i) a layer arranged between a dye-producing layer and an image-receiving layer or (ii) a layer other than the layer(s) arranged between a dye-producing layer and an image-receiving layer. In particular, the latter case (ii) is preferred.

In incorporating the present compounds represented by general formula (I) into a hydrophilic colloid layer, various known methods can be used. In general, the incorporation can be carried out using an oil-in-water dispersion method known as oil-protected method. Specifically, the compounds of general formula (I) are dissolved in a mixture of a high boiling organic solvent, such as a phosphoric acid ester, a phthalic acid ester, etc., with a low boiling auxiliary solvent, and then dispersed into a surfactant-containing aqueous gelatin solution; or water or an aqueous gelatin solution is added to a solution containing the compounds of general formula (I) and a surfactant so as to cause the phase inversion therein, thereby preparing an oil-in-water dispersion. If the compounds of the present invention are soluble in alkali, on the other hand, the so-called Fischer's dispersion method can be adopted. In removing the low boiling solvent from the thus obtained dispersion, distillation, noodle washing, ultrafiltration or like treatment can be used to advantage.

As for the dispersing medium for the compounds of general formula (I), high boiling organic solvents having a dielectric constant of 2–20 (at 25° C.) and a refractive index of 1.4–1.7 and/or water-insoluble high molecular compounds disclosed in U.S. Pat. No. 4,857,449, on columns 7–15, and WO 88/00723, at pages 12–30, can be preferably used. It is desirable that the ratio of such a dispersing medium to the compounds of general formula (I) be in the range of 0.1 to 10, preferably 0.3 to 3 by weight.

Now, constituent elements which can be contained in the color diffusion transfer photosensitive material of the present invention are illustrated successively.

I. Photosensitive Sheet

A) Support

Any of smooth transparent supports generally used for photographic materials can be used as the support of a photosensitive sheet which can be used in the present invention. Examples of such supports include a cellulose acetate film, a polystyrene f film, a polyethylene terephthalate film , a polycarbonate film and so on. It is preferable for the support to be provided with a subbing layer. For preventing a light-piping phenomenon, it is desirable that the support contain a slight amount of dye or pigment such as titanium oxide.

The thickness of the support is in the range of 50 to 350 μm, preferably 70 to 210 μm, and particularly preferably 80 to 150 μm.

On the back side of the support, a layer for adjusting curl balance or a layer impervious to oxygen as disclosed in JP-A-56-78833 can be provided, if needed.

B) Image-Receiving Layer

A dye image-receiving layer which can be used in the present invention is a layer containing a mordant incorporated in a hydrophilic colloid. This layer may be a single layer, or it may have a multilayer structure such that various mordants differing in mordanting power are coated to form a multiple layer. The detail description thereof can be found in JP-A-61-252551. As for the mordant, a polymeric mordant is preferred.

The term "a polymeric mordant" as used herein is intended to include polymers containing secondary or tertiary amino groups, polymers containing nitrogen-containing heterocyclic moieties and polymers containing quaternary cations. It is preferable for these polymers to have a molecular weight of at least 5,000, particularly at least 10,000.

The amount of a mordant coated is generally in the range of 0.5 to 10 g/m$^2$, preferably 1.0 to 5.0 g/m$^2$, and particularly preferably 2 to 4 g/m$^2$.

As for the hydrophilic colloid which can be used in the image-receiving layer, gelatin, polyvinyl alcohol, polyacrylamide, polyvinyl pyrrolidone and the like are examples thereof. In particular, gelatin is preferred.

In the image-receiving layer, the discoloration inhibitors disclosed in JP-A-62-30620, JP-A-62-30621 and JP-A-62-215272 can be incorporated.

C) Light-Reflecting White Layer

A light-reflecting white layer, which constitutes the white background of dye images, generally contains a white pigment and a hydrophilic binder. Suitable examples of a white pigment for the light-reflecting white layer include barium sulfate, zinc oxide, barium stearate, silver flake, silicates, alumina, zirconium oxide, sodium zirconium sulfate, kaolin, mica, titanium dioxide and so on. In addition, particles of a non-filming polymer, such as styrene, can be used as a white pigment. These pigments may be used alone. Also, they can be used as a mixture of two or more thereof, provided that the mixture can provide a desired reflectance.

The white pigment which is useful in particular is titanium dioxide.

The whiteness of the light-reflecting white layer depends on the species of the pigment used, the ratio of the pigment to the binder mixed therewith and the coverage of the pigment. However, it is desirable that the white layer be designed so as to have light reflectance of at least 70%. In general, the whiteness increases with an increase in coverage of the pigment, while the pigment resists the diffusion of image-forming dyes when the dyes go through this layer in the course of their diffusion. Therefore, it is to be desired that the pigment have a proper coverage.

For instance, it is preferable for the light-reflecting white layer to have a titanium oxide coverage of from 5 to 40 g/m$^2$, preferably from 10 to 25 g/m$^2$, and a light reflectance of from 78 to 85% at the wavelength of 540 nm.

The titanium dioxide used herein can be chosen from commercial products of various brands. In particular, titanium dioxide of rutile type is preferred.

Many of commercially available ones are those which have undergone surface treatment with alumina, silica, zinc oxide or the like. For achieving high reflectance, it is desirable to use a titanium dioxide having a treated surface rate of at least 5%. Suitable examples of commercial titanium dioxide include Ti-pure R931 produced by E. I. Du Pont de Nemours & Co. Inc., and those described in *Research Disclosure*, No. 15162.

As a binder of the light-reflecting white layer, an alkali-permeable polymer matrix, e.g., gelatin, polyvinyl alcohol or a cellulose derivative such as hydroxyethyl cellulose, carboxymethyl cellulose, etc., can be used.

of these polymers, gelatin is the most preferred binder for the light-reflecting white layer. The ratio of the white pigment to gelatin ranges from 1/1 to 20/1 (by weight), preferably from 5/1 to 10/1 (by weight).

In the light-reflecting white layer, it is desirable to incorporate the discoloration inhibitors as disclosed in JP-B-62-30620 and JP-B-62-30621 (the term "JP-B" as used herein means an "examined Japanese patent publication").

D) Light-Shielding Layer

A light-shielding layer containing a light-shielding agent and a hydrophilic binder is provided between the light-reflecting white layer and a photographic element.

As for the light-shielding agent, carbon black is preferred; although there can be used any of materials capable of functioning as a light shade. Also, the decomposable dyes as disclosed, e.g., in U.S. Pat. No. 4,615,966 may be used.

As for the binder, gelatin is used to advantage in forming the layer containing a light-shielding agent. Besides gelatin, any of materials in which carbon black can be dispersed may be used as binder.

As a carbon black source, there can be used those prepared by any of the methods as described in Donnel Voet, *Carbon Black*, Marcel Dekker, Inc. (1976), including channel, thermal and furnace methods. The carbon black is not particularly restricted as to grain size, but it is desirable that the grain size thereof be in the range of 90 to 1,800 Å. The amount of a black pigment added as light-shielding agent is controlled depending on thee sensitivity of a photosensitive material to be shielded from light. Desirably, the amount of a black pigment is determined so that the optical density ranging from about 5 to about 10 may be obtained.

E) Photographic Element

In the present invention, a photographic element which are constituted of a plurality of silver halide emulsion layers having respectively associated therewith dye image-forming materials is provided on the upper side of the foregoing light-shielding layer. The materials constituting the photographic element are described below in detail.

(1) Dye Image-Forming Substances

Dye image-forming substances used in the present invention are non-diffusible compounds which can release diffusible dyes (including precursors thereof) in connection with silver development, or Compounds which can change their diffusibility in connection with silver development. Such compounds are described in T. H. James, *The Theory of the Photographic Process*, 4th edition. They all can be represented by the following general formula (IV):

$$(\text{DYE-Y})_n-\text{Z} \qquad \text{(IV)}$$

wherein DYE represents a dye moiety, or a temporarily short-shifted dye moiety or a precursor thereof; Y represents a bond or a linkage group; Z represents a group having a property such that, corresponding to or counter-corresponding to the latent image distributed imagewise among light-sensitive silver halide grains, the group can cause a difference in the diffusibility of the compound represented by $(\text{DYE-Y})_n-\text{Z}$ or it can cause the release of DYE and be responsible for a difference in diffusibility between the released DYE and $(\text{DYE-Y})_n-\text{Z}$; and n represents 1 or 2, and when n is 2, two (DYE-Y)'s may be the same or different.

The foregoing compounds are divided into two classes depending on the function of Z; one class consists of negative compounds which come to have diffusibility in the developed silver area, and the other class consists of positive compounds which come to have diffusibility in the undeveloped area.

Examples of the group Z as the negative type include those which can cleave when oxidized as a result of development, thereby releasing diffusible dyes.

Specific examples thereof are disclosed, e.g., in U.S. Pat. Nos. 3,928,312, 3,993,638, 4,076,529, 4,152,153, 4,055,428, 4,053,312, 4,198,235, 4,179,291, 4,149,892, 3,844,785, 3,443,943, 3,751,406, 3,443,939, 3,443,940, 3,628,952, 3,980,479, 4,183,753, 4,142,891, 4,278,750, 4,139,379, 4,218,368, 3,421,964, 4,199,355, 4,199,354, 4,135,929, 4,336,322 and 4,139,389, JP-A-53-50736, JP-A-51-104343, JP-A-54-130122, JP-A-53-110827, JP-A-56-12642, JP-A-56-16131, JP-A-57-4043, JP-A-57-650, JP-A-57-20735, JP-A-53-69033, JP-A-54-130927, JP-A-56-164342, JP-A-57-119345, and so on.

of the groups as Z contained in dye-releasing redox compounds of the negative type, N-substituted sulfamoyl groups (wherein the N-substituent group includes groups derived from aromatic hydrocarbon or hetero rings) are preferred in particular. Representatives of these groups as Z are illustrated below. However, Z in the present invention should not be construed as being limited to these examples.

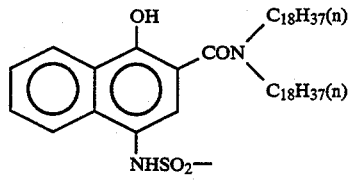

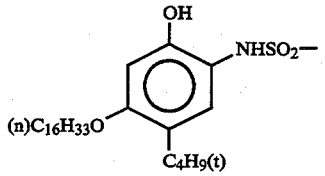

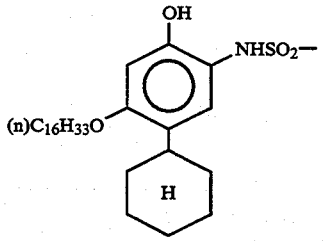

-continued

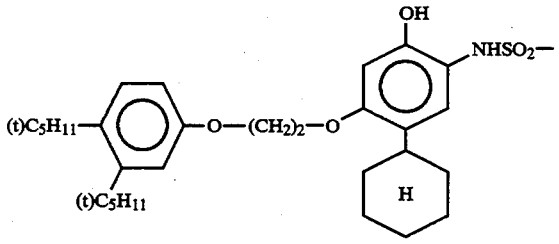

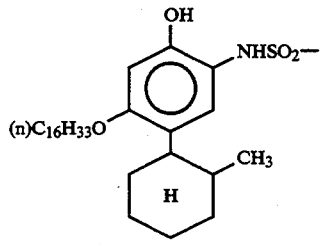

Compounds of the positive type are described in *Angew. Chem. Inst. Ed. Engl.*, vol. 22, p. 191 (1982).

Examples thereof include developing dyes, or compounds of the kind which are originally diffusible under an alkaline condition but become non-diffusible by undergoing the oxidation through development. As for the group Z which is effective for the compounds of this kind, those cited in U.S. Pat. No. 2,983,606 are typical examples.

As another group of the positive type compounds, there can be instanced compounds of the kind which can release diffusible dyes under an alkaline condition through self ring-closure or so on but substantially lose their dye-releasing function when oxidized through development. Specific examples of the group Z from which the above-described function is originated are disclosed, e.g., in U.S. Pat. No. 3,980,479, JP-A-53-69033, JP-A-54-130927, U.S. Pat. Nos. 3,421,964, 4,199,355, and so on.

As still another group of the positive type compounds, there can be instanced compounds of the kind which cannot release any dyes in themselves but can release dyes when reduced. The compounds of this kind are used in combination with electron donors, so that they can release diffusible dyes with an imagewise distribution through the reaction with electron donor molecules other than those which have undergone imagewise oxidation by silver development. The groups having the foregoing function are disclosed, e.g., in U.S. Pat. Nos. 4,183,753, 4,142,891, 4,278,750, 4,139,379 and 4,218,368, JP-A-53-110827, U.S. Pat. Nos. 4,278,750, 4,356,249 and 4,358,525, JP-A-54-130927, JP-A-56-164342, Kohkai Giho 87-6299, EP-A2-0220746, and so on.

Specific examples of groups as Z effective for the foregoing compounds are illustrated below. However, the invention should not be construed as being limited to these examples.

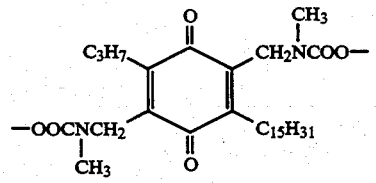

-continued

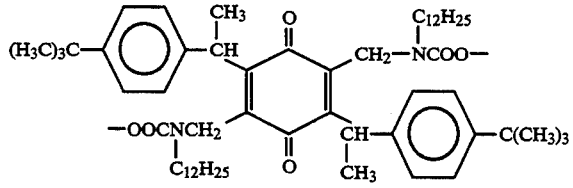

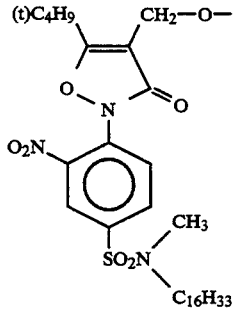

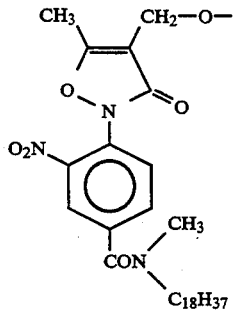

When the compounds containing as Z groups as illustrated above are used, it is preferable that they be combined with non-diffusible electron-donating compounds (known as ED compounds) or precursors thereof. Specific examples of ED compounds are disclosed, e.g., in U.S. Pat. Nos. 4,263,393 and 4,278,750, JP-A-56-138736, and so on.

Other types of dye image-forming substances which can be used in the present invention are illustrated below.

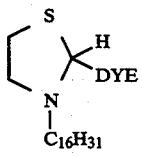

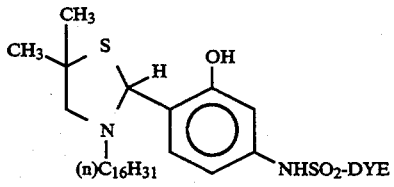

In the foregoing for formulae, DYE represents the same dye or dye precursor as defined in formula (IV).

Details of the above-illustrated compounds are described in U.S. Pat. Nos. 3,719,489 and 4,098,783.

On the other hand, examples of dyes represented by DYE in the foregoing general formulae include those disclosed, e.g., in the references cited below.

More specifically, suitable examples of DYE as yellow dye include those disclosed in U.S. Pat. Nos. 3,597,200, 3,309,199, 4,013,633, 4,245,028, 4,156,609, 4,139,383, 4,195,992, 4,148,641, 4,148,643 and 4,336,322 JP-A-51-114930, JP-A-56-71072, *Research Disclosure*, No. 17630 (1978) and No. 16475 (1977).

Suitable examples of DYE as magenta dye include those disclosed in U.S. Pat. Nos. 3,453,107, 3,544,545, 3,932,380, 3,931,144, 3,932,308, 3,954,476, 4,233,237, 4,255,509, 4,250,246, 4,142,891, 4,207,104 and 4,287,292, JP-A-52-106727, JP-A-53-23628, JP-A-55-36804, JP-A-56-73057, JP-A-56-71060, and JP-A-55-134.

Suitable examples of DYE as cyan dye include those disclosed in U.S. Pat. Nos. 3,482,972, 3,929,760, 4,013,635, 4,268,625, 4,171,220, 4,242,435, 4,142,891, 4,195,994, 4,147,544 and 4,148,642, U.K. Patent 1,551,138, JP-A-54-99431, JP-A-52-8827, JP-A-53-47823, JP-A-53-143323, JP-A-54-99431, JP-A-56-71061, European Patents 53,037 and 53,040, *Research Disclosure*, No. 17630 (1978) and No. 16475 (1977).

The compounds as described above can be dispersed using methods disclosed in JP-A-62-215257, at pages 144–146. In the resulting dispersions, the compounds disclosed in JP-A-62-215272 may be contained.

(2) Silver halide emulsions

In the present invention, there may be used either a negative emulsion which form a latent image predominantly at the surface of the grains or an internally sensitive direct-positive emulsion which forms a latent image inside the grains.

Examples of an internally sensitive direct-positive emulsion include the so-called "conversion type" emulsions which are prepared utilizing the solubility difference between silver halides, and "core/shell type" emulsions comprising the silver halide grains constructed by a metal ion-doped or/and chemically sensitized inner part (core) and an outer part (shell) which covers at least the sensitive sites of the core. Details of these emulsions are described in U.S. Pat. Nos. 2,592,250 and 3,206,313, U.K. Patent 1,027,146, U.S. Pat. Nos. 3,761,276, 3,935,014, 3,447,927, 2,297,875, 2,563,785, 3,551,662 and 4,395,478, West German Patent 2,728,108, U.S. Pat. No. 4,431,730, and so on.

When the internally sensitive direct-positive emulsions are used, it is required to form fog nuclei at the grain surface by the irradiation with light or by the use of a nucleating agent after imagewise exposure.

Suitable examples of a nucleating agent used for the above-described purpose include the hydrazines disclosed in U.S. Pat. No. 2,563,785 and 2,588,982, the hydrazines and the hydrazones disclosed in U.S. Pat. No. 3,227,552, the heterocyclic quaternary salt compounds as disclosed in U.K. Patent 1,283,835, JP-A-52-69613, and U.S. Pat. Nos. 3,615,615, 3,719,494, 3,734,738, 4,094,683 and 4,115,122, the sensitizing dyes disclosed in U.S. Pat. No. 3,718,470, which contain substituents having a nucleating function in their respective dye molecules, the thiourea-attached acylhydrazine compounds as disclosed in U.S. Pat. Nos. 4,030,925, 4,031,127, 4,245,037, 4,255,511, 4,266,013 and 4,276,364, and U.K. Patent 2,012,443, and the acylhydrazine compounds to which a thioamide ring or a heterocyclic ring such as triazole, tetrazole or the like is attached as adsorptive group, which are disclosed in U.S. Pat. Nos. 4,080,270 and 4,278,748, U.K. Patent 2,011,391 B, and so on.

In combination with negative emulsions and internally sensitive direct-positive emulsions as described above, spectral sensitizing dyes are used in the present invention. Specific examples of such dyes include those disclosed in JP-A-59-180550, JP-A-60-140335, *Research Disclosure*, No. 17029, U.S. Pat. Nos. 1,846,300, 2,078,233, 2,089,129, 2,165,338, 2,231,658, 2,917,516, 3,352,857, 3,411,916, 2,295,276, 2,481,698, 2,688,545, 2,921,067, 3,282,933, 3,397,060, 3,660,103, 3,335,010, 3,352,680, 3,384,486, 3,623,881, 3,718,470 and 4,025,349, and so on.

(3) Constitution of Photographic Element

Color reproduction according to the subtractive color process can be effected using a photographic element which comprises at least two light-sensitive emulsions, which have been respectively sensitized with spectral sensitizing dyes as cited above, respectively associated therewith dye image-providing substances which can provide the dyes showing selective spectral absorption in the same wavelength regions where their corresponding emulsions have the sensitivities. Each emulsion and the dye image-forming substance used in combination therewith may be coated in separate layers, or they may be mixed and coated in a single layer. When the dye image-forming substance coated in a layer absorbs light within the wavelength region where the emulsion associated therewith has spectral sensitivities, it is preferable for them to be coated in separate layers. Each emulsion layer may be composed of two or more layers differing in sensitivity. Further, some layer may be provided between each emulsion layer and the dye image-forming substance layer associated therewith. For instance, providing therebetween the nucleation development accelerator-containing layer disclosed in JP-A-60-173541 or the partition layer disclosed in JP-B-60-15267 is advantageous in heightening dye image density, and providing therebetween a light-reflecting layer enables an increase in sensitivity of the resulting photographic element.

The light-reflecting layer is a layer containing a white pigment and a hydrophilic binder. Therein, titanium oxide and gelatin are preferred as the white pigment and the binder, respectively. The suitable coverage of titanium oxide is in the range of 0.1 to 8 $g/m^2$, preferably 0.2 to 4 $g/m^2$. Specific examples of such a layer are described in JP-A-60-91354.

In a desirable multi-layered constitution, a blue-sensitive emulsion combined unit, a green-sensitive emulsion combined unit and a red-sensitive emulsion combined unit are arranged in that order, starting from the exposure side.

Any layers may be provided between adjacent emulsion layer units, if desired. For preventing some emulsion layer unit from having adverse effects on another emulsion layer unit as a result of development, it is desired in particular to provide an interlayer between those units.

When a developing agent is used in combination with non-diffusible dye image-forming substances, it is desirable that the interlayer contain a non-diffusible reducing agent, because the agent can inhibit the oxidation product of said developing agent from diffusing. Suitable examples of such a reducing agent include non-diffusible hydroquinones, sulfonamidophenols and sulfonamidonaphthols. More specifically, those disclosed in JP-A-50-21249, JP-A-50-23813, JP-A-49-106329, JP-A-49-129535, U.S. Pat. Nos. 2,336,327, 2,360,290, 2,403.,721, 2,544,640, 2,732,300, 2,782,659, 2,937,086, 3,637,393 and 3,700,453, U.K. Patent 557,750, JP-A-57-24941, JP-A-58-21249 and so on can be used as the compounds cited above. As for the method of diffusing such a reducing agent, those disclosed in JP-A-60-238831 and JP-B-60-18978 can be adopted.

When there are used the compounds as disclosed in JP-B-55-7576, which can release diffusible dyes when silver ion acts thereon, it is desirable that the interlayer contain a compound capable of capturing silver ion.

Further, an irradiation preventing layer, a UV absorber layer, a protective layer and so on can be provided, if needed.

F) Releasable Layer

In the photosensitive sheet of a color film unit, a releasable layer can be provided for the purpose of delaminating the sheet at an arbitrary position after photographic processing, if needed. Accordingly, it is necessary for the releasable layer to be peeled apart with ease after photographic processing. Examples of a material used for the releasable layer include those disclosed in JP-A-47-8237, JP-A-59-220727, JP-A-59-229555, JP-A-49-4653, U.S. Pat. Nos. 3,220,835 and 4,359,518, JP-A-49-4334, JP-A-56-65133, JP-A-45-24075, U.S. Pat. Nos. 3,227,550, 2,759,825, 4,401,746 and 4,366,227, and so on. More specifically, water-soluble (or alkali-soluble) cellulose derivatives can be instanced as such materials. As for the cellulose derivatives, hydroxyethyl cellulose, cellulose acetate phthalate, plasticized methyl cellulose, ethyl cellulose, cellulose nitrate, carboxymethyl cellulose and the like are examples thereof. In addition, various natural polymers including alginic acid, pectin and gum arabic can be other examples of the foregoing materials. Also, various modified gelatins, such as acetylated gelatin and phthalated gelatin, can be still other examples. Further, water-soluble synthetic polymers can be instanced, with suitable examples including polyvinyl alcohol, polyacrylate, polymethylmethacrylate, polybutylmethacrylate and copolymers containing the constituent monomers of the above-cited polymers.

The releasable layer may be a single layer, or may be constituted of at least two layers as disclosed, e.g., in JP-A-59-220727 and JP-A-60-60642.

II. Cover Sheet

In the present invention, there is used a transparent cover sheet which comprises an element having the function of neutralization (including a neutralizing layer and a neutralization rate controlling layer) in order to neutralize the alkali remaining on a photographic element after uniformly spreading a processing solution over the element, and thereby to stabilize the images formed therein.

G) Support

Any of smooth transparent supports generally used for photographic materials can be used as the support of a cover sheet which can be used in the present invention. Examples of such supports include a cellulose acetate film, a polystyrene film, a polyethylene terephthalate film, a polycarbonate film and so on. It is preferable for the support to be provided with a subbing layer.

For preventing a light-piping phenomenon, it is desirable that the support contain a slight amount of dye.

H) Element having Function of Neutralization

The element having a function of neutralization which can be used in the present invention comprises a layer containing an acidic substance in a sufficient quantity to neutralize the alkali brought thereinto from a processing composition (or a neutralizing layer). That element may take a multi-layered structure, if needed, and it can further contain a neutralization rate controlling layer (or a neutralization timing layer), an adhesion reinforcing layer, and so on. Suitable examples of an acidic substance as described above include those containing an acidic group of a pKa of no greater than 9 (or containing a precursor group capable of providing such an acidic group upon hydrolysis). Those preferred as such substances include higher fatty acids including oleic acid as described in U.S. Pat. No. 2,983,606; the polymers containing acrylic acid, methacrylic acid or maleic acid as a main constituent monomer and the partial esters or acid anhydrides of such polymers, as disclosed in U.S. Pat. No. 3,362,819; the copolymers of acrylic acid and acrylates as disclosed in French Patent 2,290,699; and the latex-form acidic polymers as disclosed in U.S. Pat. No. 4,139,383 and *Research Disclosure*, No. 16102 (1977).

In addition, the acidic substances disclosed in U.S. Pat. No. 4,088,493, JP-A-52-153739, JP-A-53-1023, JP-A-53-4540, JP-A-53-4541, JP-A-53-4542 and so on can be instanced.

The above-cited acidic polymers (or polymeric acids) are specifically a copolymer of maleic anhydride and a vinyl monomer such as ethylene, vinyl acetate, vinyl methyl ether, etc., the n-butyl ester of such a copolymer, a copolymer of acrylic acid and a butylacrylate, cellulose acetate hydrogenphthalate, and so on.

The foregoing polymeric acids can be used in the form of mixture with a hydrophilic polymer. Specific examples of such a hydrophilic polymer include polyacrylamide, polymethyl pyrrolidone, polyvinyl alcohol (including partially saponified products), carboxymethyl cellulose, hydroxymethyl cellulose, hydroxyethyl cellulose, polymethylvinyl ether, and so on of these polymers, polyvinyl alcohol is preferred.

The coverage rate of a polymeric acid is controlled depending on the amount of an alkali spread over the photographic element. Therein, it is desirable that the ratio of the polymeric acid to the alkali be in the range of 0.9 to 2.0 by equivalent per unit area. When the amount of a polymeric acid used is too small, transferred dyes suffer a change in hue or stains are generated on the white ground; while when it is too large, unfavorable matters including a change in hue and the lowering of light resistance are caused in the transferred dyes. The more desirable ratio of the polymeric acid to the alkali ranges from 1.0 to 1.3 by equivalent per unit area. The hydrophilic polymer also, which is mixed with a polymeric acid, deteriorates the photographic quality whether the amount used is too small or too large. The ratio of the hydrophilic polymer to the polymeric acid ranges from 0.1 to 10 by weight, preferably from 0.3 to 3.0 by weight.

Into the element having a neutralizing function, additives can be incorporated for various purposes. For instance, conventional hardeners can be added for hardening that element, and polyhydric hydroxyl-containing compounds, such as polyethylene glycol, polypropylene glycol, glycerine and the like, can be added for improving film's brittleness. Further, an antioxidant, a brightening agent, a development inhibitor and precursors thereof can be added, if needed.

For the timing layer used in combination with the neutralizing layer, there can be effectively used (i) polymers capable of lowering alkali perviousness, with examples including gelatin, polyvinyl alcohol, partially acetalated polyvinyl alcohols, cellulose acetate, partially hydrolyzed polyvinyl acetates and the like, (ii) latex polymers capable of heightening the activation energy for alkali perversion, which are prepared using a small amount of hydrophilic comonomer, e.g., acrylic acid monomer, in the copolymerization reaction, (iii) polymers having a lactone ring, and so on.

As for the foregoing polymers (i), the timing layers using cellulose acetate disclosed, e.g., in JP-A-54-136328 and U.S. Pat. Nos. 4,267,262, 4,009,030 and 4,029,849 are useful. As for the foregoing latex polymers (ii), the latex polymers disclosed, e.g., in JP-A-54-128335, JP-A-56-69629, JP-A-57-6843 and U.S. Pat. Nos. 4,056,394, 4,061,496, 4,199,362, 4,250,243, 4,256,827 and 4,268,604 are useful in forming the timing layer. As for the foregoing polymers (iii), the lactone ring-containing polymers disclosed in U.S. Pat. No. 4,229,516 are useful. Specific examples of other polymers which can be useful in forming the timing layer include those disclosed, e.g., in JP-A-56-25735, JP-A-56-97346, JP-A-57-6842, EP-A1-0031957, EP-A1-0037724, and EP-A1-0048412.

In addition to the above-recited polymers, there can be used the polymers disclosed in U.S. Pat. Nos. 3,421,893, 3,455,686, 3,575,701, 3,778,265, 3,785,815 3 847 615, 4,088,493, 4,123,275, 4,148,653, 4,201,587, 4,288,523 and 4,297,431, West German Patent Application (OLS) Nos. 1,622,936, 2,162,277, and *Research Disclosure*, No. 15162 (1976).

The timing layer using a material as recited above may be a single layer or a combination of two or more layers.

Into the timing layers comprising materials as recited above, it is feasible to further incorporate the development inhibitors and/or precursors thereof as disclosed, e.g., in U.S. Pat. No. 4,009,029, West German Patent Application (OLS) Nos. 2,913,164 and 3,014,672, JP-A-54-155837 and JP-A-55-138745, the hydroquinone precursors disclosed in U.S. Pat. No. 4,201,578, or/and other useful photographic additives or precursors thereof.

Moreover, as disclosed in JP-A-63-168648 and JP-A-63-168649, it is effective to provide an auxiliary neutralizing layer as a constituent layer of the element having the neutralizing function. This is because that layer can reduce the change occurring in transferred image density with the lapse of time.

I) Others

In addition to the element having a function of neutralization, the cover sheet may contain layers having auxiliary functions, such as a backing layer, a protective layer, a filter dye layer and so on.

The backing layer is provided for the purposes of controlling a curling phenomenon of the cover sheet and imparting slippability to the cover sheet. This layer may contain filter dyes also.

The protective layer is provided for preventing the front face of one cover sheet from adhering to the back face of other cover sheet when they are superposed on each other, and for preventing the cover sheet from adhering to the protective layer of a photosensitive material when they are brought into a face-to-face contact with each other.

Further, the cover sheet enables the sensitivity control of light-sensitive layers by containing dyes therein.

Filter dyes may be added directly to a composition for forming a constituent element of the cover sheet, including a backing layer, a protective layer and a capturing and mordanting layer as well as the support and the element having a function of neutralization, or may be coated as an independent layer.

III. Alkaline Processing Composition

A processing composition used in the present invention is uniformly spread over the optically exposed photographic element, and thereby completely protects the light-sensitive layers from ambient light in cooperation with the light-shielding layer arranged on the back side of the support or on the side opposite to the processing solution-spread side of the photographic element and, at the same time, causes development in the light-sensitive layers by the use of ingredients contained therein. Therefore, the processing composition contains not only alkalis, a thickening agent, a light-shielding agent and a developing agent, but also agents for controlling development, such as a development accelerator and a development restrainer, antioxidants for inhibiting the developing agent from deteriorating, and so on. Additionally, the light-shielding agent is necessary for the processing composition.

The alkalis are used in a sufficient quantity to adjust the processing composition to pH 12–14. Suitable examples of such alkalis include hydroxides of alkali metals (such as sodium hydroxide, potassium hydroxide, lithium hydroxide), phosphates of alkali metals (such as potassium phosphate), guanidines, hydroxides of quaternary amines (such as tetramethylammonium hydroxide), and so on of these alkalis, potassium hydroxide and sodium hydroxide are preferred.

The thickening agent is necessary to uniformly spread the processing solution, and to secure the adhesion between the photographic element and the cover sheet. Suitable examples thereof include polyvinyl alcohol, hydroxyethyl cellulose, and alkali metal salts of carboxymethyl cellulose. Among these, hydroxyethyl cellulose and sodium salt of carboxymethyl cellulose are preferred as thickening agent.

The light-shielding agent which can be used includes any of dyes, pigments and combinations thereof, unless it diffuses into the dye image-receiving layer to result in staining that layer. Specifically, carbon black is representative of such materials.

The developing agent which can be preferably used includes any of compounds which can cross-oxidize dye image-forming substances and, what is more, don't substantially give rise to stains even when oxidized. The compounds of such a kind may be used alone or as a mixture of two or more thereof, or they may be used in the form of precursor. The developing agent as described above may be incorporated in an appropriate constituent layer of the photographic element, or may be contained in the alkaline processing solution. Typical compounds as the developing agent are aminophenols and pyrazolidinones. However, pyrazolidinones are preferred because they can reduce the generation of stains.

Specific examples of such pyrazolidinones include 1-phenyl-3-pyrazolidinone, 1-p-tolyl-4,4-dihydroxymethyl-3-pyrazolidinone, 1-(3'-methylphenyl)-4-methyl-4-hydroxymethyl-3-pyrazolidinone, 1-phenyl-4-methyl-4-hydroxymethyl-3-pyrazolidinone, 1-p-tolyl-4-methyl-4-hydroxymethyl-3-pyrazolidinone, and the like.

In the photosensitive sheet, the cover sheet or the alkaline processing composition, there can be contained any of the development accelerators disclosed in JP-A-62-215272, at pages 72–91, any of the hardeners disclosed in supra, at pages 146–155, any of the surfactants disclosed in supra, at pages 201–210, any of the fluorine-containing compounds disclosed in supra, at pages 210–222, any of the thickening agents disclosed in supra, at pages 225–227, any of the antistatic agents disclosed in supra, at pages 227–230, any of the polymer latexes disclosed in supra, at pages 230–239, and any of the matting agents disclosed in supra, at page 240.

The present invention will now be described in detail by way of the following examples, but the invention should not be construed as being limited to these examples.

EXAMPLE 1

A photographic element for comparison (Comparative Photographic Element 101) was prepared using as a support a 150 μm-thick transparent polyethylene terephthalate film and performing coating operations so as to have the layer structure shown in Table A.

TABLE A

| Constitution of Comparative Photographic Element 101: | | | |
|---|---|---|---|
| Number of Layer | Name of Layer | Ingredients | Coverage ($g/m^2$) |
| 21st | Protective layer | Gelatin | 1.00 |
| | | Matting agent (1) | 0.25 |
| 20th | Ultraviolet absorbing layer | Gelatin | 0.50 |
| | | Ultraviolet absorbent (1) | $4.0 \times 10^{-4}$ |
| | | Ultraviolet absorbent (2) | $4.0 \times 10^{-4}$ |
| 19th | Yellow-sensitive layer (high sensitivity) | Direct positive emulsion of internal latent image type (having an octahedral crystal form and a grain size of 1.7 μm) | 0.60 (based on silver) |
| | | Sensitizing dye (3) | $1.4 \times 10^{-3}$ |
| | | Nucleating agent (1) | $6.8 \times 10^{-8}$ |
| | | Additive (2) | 0.03 |
| | | Gelatin | 0.70 |
| 18th | Yellow-sensitive layer (low sensitivity) | Direct positive emulsion of internal latent image type (having an octahedral crystal form and a grain size of 1.1 μm) | 0.25 (based on silver) |
| | | Sensitizing dye (3) | $9.0 \times 10^{-4}$ |
| | | Nucleating agent (1) | $8.0 \times 10^{-8}$ |
| | | Additive (2) | $4.5 \times 10^{-2}$ |
| | | Gelatin | 0.40 |
| 17th | Light-reflecting white layer | Titanium dioxide | 0.70 |
| | | Gelatin | 0.18 |
| 16th | Yellow color material layer | Yellow dye-releasing compound (1) | 0.53 |
| | | High boiling organic solvent (1) | 0.13 |
| | | Additive (1) | $1.4 \times 10^{-2}$ |
| | | Gelatin | 0.70 |
| 15th | Interlayer | Gelatin | 0.30 |
| 14th | Color stain inhibiting layer | Additive (1) | 0.80 |
| | | Polymethylmethacrylate | 0.80 |
| | | Gelatin | 0.45 |
| 13th | Green-sensitive layer (high sensitivity) | Direct positive emulsion of internal latent image type (having an octahedral crystal form and a grain size of 1.6 μm) | 0.80 (based on silver) |
| | | Sensitizing dye (2) | $2.1 \times 10^{-3}$ |
| | | Nucleating agent (1) | $2.5 \times 10^{-8}$ |
| | | Additive (2) | 0.08 |
| | | Gelatin | 1.00 |
| 12th | Green-sensitive layer (low sensitivity) | Direct positive emulsion of internal latent image type (having an octahedral crystal form and a grain size of 1.0 μm) | 0.25 (based on silver) |
| | | Sensitizing dye (2) | $1.1 \times 10^{-3}$ |
| | | Nucleating agent (1) | $4.4 \times 10^{-8}$ |
| | | Additive (2) | 0.30 |
| | | Gelatin | 0.50 |
| 11th | Light-reflecting white layer | Titanium dioxide | 1.00 |
| | | Gelatin | 0.25 |
| 10th | Magenta color material layer | Magenta dye-releasing compound (1) | 0.50 |
| | | High boiling organic solvent (1) | 0.10 |
| | | Additive (1) | $9.0 \times 10^{-3}$ |

TABLE A-continued

| Constitution of Comparative Photographic Element 101: | | | |
|---|---|---|---|
| Number of Layer | Name of Layer | Ingredients | Coverage ($g/m^2$) |
| | | Gelatin | 0.90 |
| 9th | Interlayer | Gelatin | 0.30 |
| 8th | Color stain inhibiting layer | Additive (1) | 1.20 |
| | | Polymethylmethacrylate | 1.20 |
| | | Gelatin | 0.70 |
| 7th | Red-sensitive layer (high sensitivity) | Direct positive emulsion of internal latent image type (having an octahedral crystal form and a grain size of 1.6 μm) | 0.50 (based on silver) |
| | | Sensitizing dye (1) | $6.2 \times 10^{-4}$ |
| | | Nucleating agent (1) | $5.0 \times 10^{-8}$ |
| | | Additive (2) | 0.04 |
| | | Gelatin | 1.80 |
| 6th | Red-sensitive layer (low sensitivity) | Direct positive emulsion of internal latent image type (having an octahedral crystal form and a grain size of 1.0 μm) | 0.15 (based on silver) |
| | | Sensitizing dye (1) | $3.0 \times 10^{-4}$ |
| | | Nucleating agent (1) | $5.0 \times 10^{-8}$ |
| | | Additive (2) | 0.02 |
| | | Gelatin | 0.40 |
| 5th | Light-reflecting white layer | Titanium dioxide | 3.00 |
| | | Gelatin | 0.80 |
| 4th | Cyan color material layer | Cyan dye-releasing compound (1) | 0.50 |
| | | High boiling organic solvent (1) | 0.10 |
| | | Additive (1) | 0.01 |
| | | Gelatin | 1.00 |
| 3rd | Opaque layer | Carbon black | 1.70 |
| | | Gelatin | 1.70 |
| 2nd | Light-reflecting white layer | Titanium dioxide | 22.00 |
| | | Gelatin | 2.75 |
| 1st | Image-receiving layer | Polymeric mordant (1) | 3.00 |
| | | Gelatin | 3.00 |
| Support (150 μm-thick polyethylene terephthalate) | | | |

Polymeric Mordant (1):

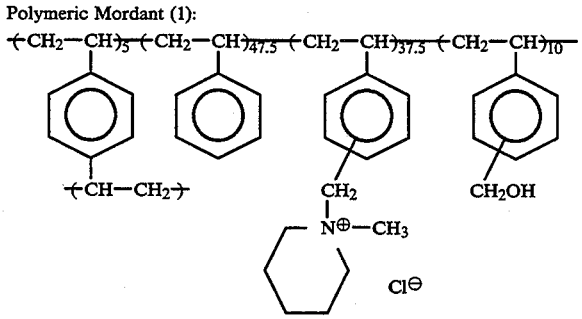

Ultraviolet Absorbent (1):

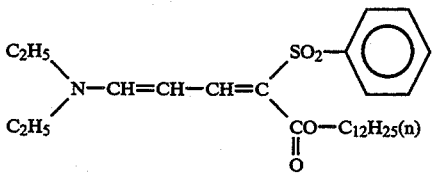

Ultraviolet Absorbent (2):

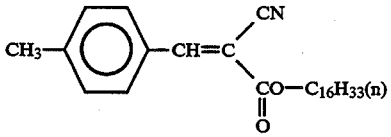

Matting Agent (1):
Spherical latex of polymethylmethacrylate
(average size: 4 μm)
Cyan Dye-Releasing Compound (1):

TABLE A-continued
Constitution of Comparative Photographic Element 101:
| Number of Layer | Name of Layer | Ingredients | Coverage ($g/m^2$) |
|---|---|---|---|
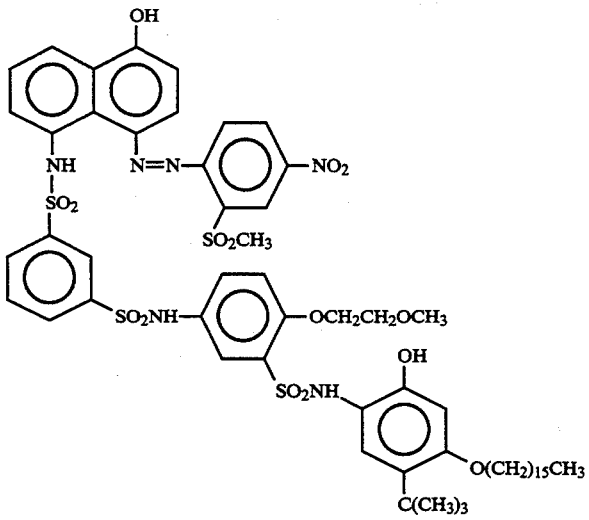
Magenta Dye-Releasing Compound (1):
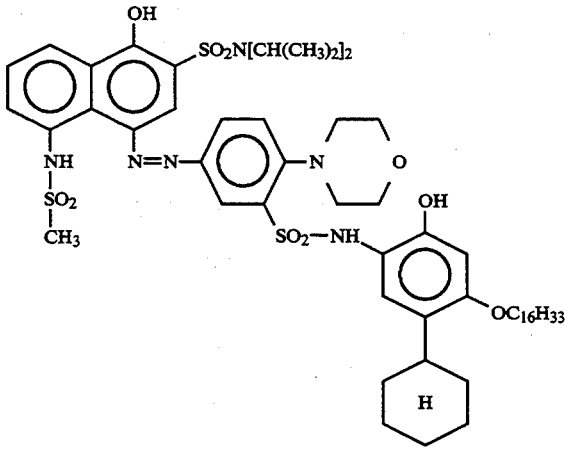
Yellow Dye-Releasing Compound (1):
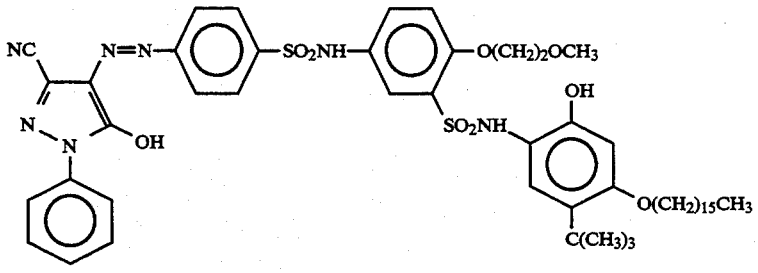
Additive (1):
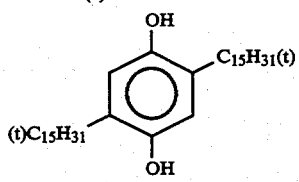
Additive (2):

TABLE A-continued

| Number of Layer | Constitution of Comparative Photographic Element 101: Name of Layer | Ingredients | Coverage ($g/m^2$) |
|---|---|---|---|

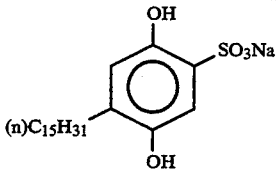

High Boiling Organic Solvent (1):
Tricyclohexyl phosphate
Nucleating Agent (1):

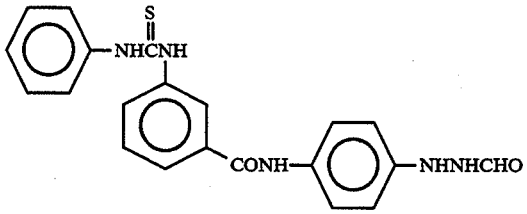

Sensitizing Dye (1):

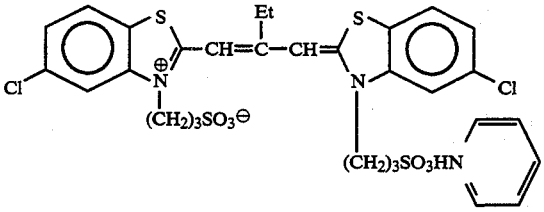

Sensitizing Dye (2):

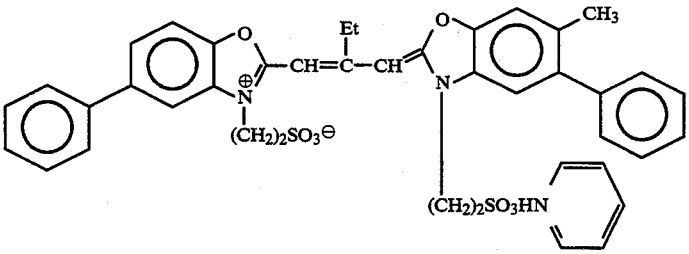

Sensitizing Dye (3):

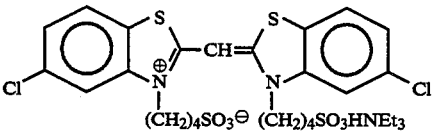

Photographic Elements 102 to 112 were each prepared so as to have the same constitution as Comparative Photographic Element 101 described above, except that a layer containing 1.0 $g/m^2$ of the compound of the present invention as set forth in Table B and 1.0 $g/m^2$ of gelatin was provided between the 20th layer and the 21st layer illustrated in Table A.

A cover sheet was prepared as follows: On a transparent polyethylene terephthalate support containing an anti-light-piping dye therein and having thereon a gelatin subbing layer, were coated the layers described below in the order listed;

(1) A neutralizing layer containing 10.4 $g/m^2$ of acrylic acid/butylacrylate (8:2 by mole) copolymer and 0.1 $g/m^2$ of 1,4-bis(2,3-epoxypropoxy)-butane.

(2) A neutralization timing layer containing 4.3 $g/m^2$ of acetyl cellulose having an acetylation degree of 51% and 0.2 $g/m^2$ of poly(methylvinylether-co-monomethylmaleate).

(3) A layer containing 1.0 $g/m^2$ (on a solids basis) of a 6:4 (by drained weight) blend of (i) the polymer latex obtained by emulsion-polymerizing a 49.7:42.3:4:4 (by weight) mixture of styrene, butylacrylate, acrylic acid and N-methylol acrylamide and (ii) the polymer latex obtained by emulsion-polymerizing a 93:3:4 (by weight) mixture of methylmethacrylate, acrylic acid and N-methylol acrylamide.

The formula of an alkaline processing composition used herein are described below:

| | |
|---|---|
| 1-p-Tolyl-4-hydroxymethyl-4-methyl-3-pyrazolidone | 10.0 g |
| Methylhydroquinone | 0.18 g |
| 5-Methylbenzotriazole | 3.0 g |
| Sodium sulfite (anhydrous) | 0.2 g |
| Benzyl alcohol | 1.5 ml |
| Sodium salt of carboxymethyl cellulose | 58 g |
| Carbon black | 150 g |
| Potassium hydroxide (28% aq. soln.) | 200 ml |
| Water | 680 ml |

0.8 g portions of the alkaline processing solution having the composition described above were charged in separate "pressure-rupturable containers".

Each of the foregoing Photographic Elements 101 to 112 was exposed to light via a gray filter from the emulsion layer side, and then superposed on the above-described cover sheet in a face-to-face relationship. Thereafter, the foregoing processing solution was spread between those two materials at 25° C. by passing them through a pair of pressure-applying rollers so as to form a layer having a thickness of 75 μm, thereby conducting photographic processing.

After the lapse of one hour from the spreading-and-processing operation, each of the thus processed samples was examined for the maximum density (reflection density) by means of a Fuji Densitometer FSD. Thereafter, each sample was allowed to stand for 7 days in the atmosphere of 35° C. and 70% RH, and then examined again for the maximum density in the same manner as described above. The results obtained are shown in Table B.

TABLE B

| Photographic Element | Compound Added | Density After One-Hour Lapse from Processing DB | DG | DR | Density After 7 Day's Standing at 35° C. · 70% RH DB | DG | DR | Note |
|---|---|---|---|---|---|---|---|---|
| 101 | — | 1.72 | 2.01 | 2.20 | 1.96 | 2.30 | 2.41 | comparison |
| 102 | R-1 (*1) | 1.21 | 1.41 | 1.60 | 1.32 | 1.60 | 1.71 | comparison |
| 103 | (3) | 1.72 | 2.01 | 2.21 | 1.79 | 2.01 | 2.31 | invention |
| 104 | (4) | 1.70 | 1.98 | 2.20 | 1.76 | 1.98 | 2.29 | invention |
| 105 | (5) | 1.72 | 2.00 | 2.19 | 1.76 | 2.00 | 2.26 | invention |
| 106 | (11) | 1.72 | 2.02 | 2.21 | 1.74 | 2.02 | 2.29 | invention |
| 107 | (9) | 1.73 | 2.02 | 2.19 | 1.74 | 2.02 | 2.25 | invention |
| 108 | (19) | 1.73 | 2.03 | 2.21 | 1.76 | 2.04 | 2.28 | invention |
| 109 | (24) | 1.72 | 2.01 | 2.20 | 1.76 | 2.02 | 2.24 | invention |
| 110 | (36) | 1.71 | 2.02 | 2.19 | 1.76 | 2.04 | 2.20 | invention |
| 111 | (39) | 1.70 | 2.01 | 2.19 | 1.74 | 2.01 | 2.26 | invention |
| 112 | (3)/(4) (*2) | 1.71 | 2.00 | 2.16 | 1.76 | 2.00 | 2.26 | invention |

(*1) The compound disclosed in U.K. Patent 1,537,079 is used as R-1 for comparison.

Formula of R-1:

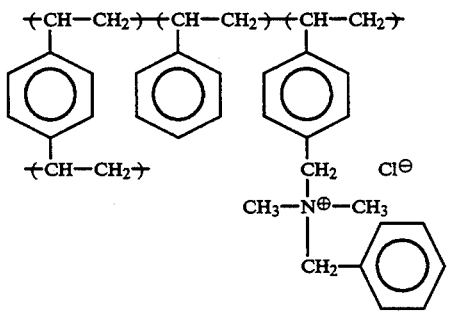

(*2) A layer containing 1.0 g/m$^2$ of Compound (3) and 1.0 g/m$^2$ of gelatin and a layer containing 0.5 g/m$^2$ of Compound (4) and 1.0 g/m$^2$ of gelatin were provided in succession between the 20th layer and the 21st layer.

As can be seen from Table B, the compounds of the present invention enabled considerable reduction in density change with the lapse of time without accompanied with any appreciable drop in the density achieved by the spreading-and-processing operation.

On the other hand, the layer containing the compound of the present invention or the compound for comparison was provided between the 3rd layer and the 4th layer, and the resulting sample (Photographic Element 113–118) was subjected to the same processing operation as described above. The results obtained are shown in Table C.

TABLE C

| Photographic Element | Compound Added | Amount added (g/m$^2$) | Density After One-Hour Lapse from Processing DB | DG | DR | Density After 7 Day's Standing at 35° C. 70% RH DB | DG | DR | Note |
|---|---|---|---|---|---|---|---|---|---|
| 101 | — | — | 1.72 | 2.01 | 2.20 | 1.96 | 2.30 | 2.41 | comparison |
| 113 | R-1(*1) | 0.016(*3) | 1.72 | 2.01 | 2.20 | 1.96 | 2.30 | 2.41 | comparison |
| 114 | " | 0.5 | 1.41 | 1.61 | 1.80 | 1.52 | 1.80 | 1.91 | comparison |
| 115 | (5) | 0.016 | 1.72 | 2.01 | 2.20 | 1.96 | 2.30 | 2.41 | invention |
| 116 | " | 0.5 | 1.72 | 2.01 | 2.20 | 1.78 | 2.04 | 2.21 | invention |
| 117 | " | 1.0 | 1.66 | 1.96 | 2.16 | 1.72 | 1.96 | 2.23 | invention |

TABLE C-continued

| Photographic Element | Compound Added | Amount added ($g/m^2$) | Density After One-Hour Lapse from Processing DB | DG | DR | Density After 7 Day's Standing at 35° C. 70% RH DB | DG | DR | Note |
|---|---|---|---|---|---|---|---|---|---|
| 118 | " | 1.5 | 1.64 | 1.94 | 2.14 | 1.70 | 1.94 | 2.20 | invention |

(*1) the compound disclosed in U.K. Patent 1,537,079.
(*3) the amount described in U.K. Patent 1.537,079.

In this case also, the foregoing data prove that the compound of the present invention effectively inhibited the density from changing with the lapse of time without accompanied with any appreciable drop in the density achieved by the spreading-and-processing operation; whereas any effective result was not obtained when the compound disclosed in U.K. Patent 1,537,079 was used in the amounts described therein.

EXAMPLE 2

Cover Sheets 201 to 212 were prepared in the same manner as the cover sheet prepared in Example 1, except that each of them had on the (3) layer a layer containing 1.0 $g/m^2$ of the compound of the present invention as set forth in Table D and 2.0 $g/m^2$ of gelatin.

The same procedure as described in Example 1 was carried out using the Photographic Element 101 prepared in Example 1 and each of the foregoing Cover Sheets 201 to 212.

After a one-day lapse from the spreading-and-processing operation, each of the processed samples was examined for the reflection density, and subsequently allowed to stand for 7 days under the atmosphere of 35° C. and 70% RH. Thereafter, the reflection density of each sample was examined again. The results obtained are shown in Table D.

TABLE D

| Cover Sheet | Compound Added | Density After One-Day Lapse from Processing DB | DG | DR | Density After 7 Day's Standing at 35° C. 70% RH DB | DG | DR | Note |
|---|---|---|---|---|---|---|---|---|
| 201 | — | 1.62 | 1.91 | 2.14 | 1.96 | 2.30 | 2.41 | comparison |
| 202 | R-2(*4) | 1.01 | 1.21 | 1.46 | 1.11 | 1.31 | 1.56 | comparison |
| 203 | (3) | 1.62 | 1.92 | 2.13 | 1.63 | 1.96 | 2.20 | invention |
| 204 | (4) | 1.64 | 1.92 | 2.14 | 1.66 | 1.96 | 2.21 | invention |
| 205 | (5) | 1.62 | 1.92 | 2.14 | 1.67 | 1.96 | 2.20 | invention |
| 206 | (12) | 1.63 | 1.91 | 2.14 | 1.66 | 1.96 | 2.20 | invention |
| 207 | (20) | 1.64 | 1.91 | 2.15 | 1.68 | 1.98 | 2.21 | invention |
| 208 | (22) | 1.62 | 1.91 | 2.14 | 1.69 | 1.94 | 2.20 | invention |
| 209 | (28) | 1.64 | 1.92 | 2.14 | 1.69 | 1.96 | 2.21 | invention |
| 210 | (30) | 1.64 | 1.92 | 2.14 | 1.69 | 1.96 | 2.21 | invention |
| 211 | (40) | 1.62 | 1.91 | 2.13 | 1.69 | 1.99 | 2.20 | invention |
| 212 | (50) | 1.64 | 1.92 | 2.13 | 1.70 | 1.99 | 2.21 | invention |

(*4) the compound disclosed in JP-A-03-53248 (the same as the polymeric mordant used in Example 1).

As can be seen from Table D, the compounds of the present invention suppressed considerably the density change with the lapse of time without accompanied with any appreciable drop in transfer density.

EXAMPLE 3

A photographic element for comparison having the constitution described below (Photographic Element 301 for comparison) was prepared.

Constitution of Photographic Element 301

On a transparent polyethylene terephthalate support, were coated the following layers to prepare a photosensitive sheet.

Layer on Back Side (a) A light-shielding layer containing 4.0 $g/m^2$ of carbon black and 2.0 $g/m^2$ of gelatin.

Layers on Emulsion Layer Side (1) A layer containing 0.44 $g/m^2$ of the cyan dye-releasing redox compound illustrated below, 0.09 $g/m^2$ of tricyclohexyl phosphate, 0.008 $g/m^2$ of 2,5-di-t-pentadecylhydroquinone and 0.8 $g/m^2$ of gelatin:

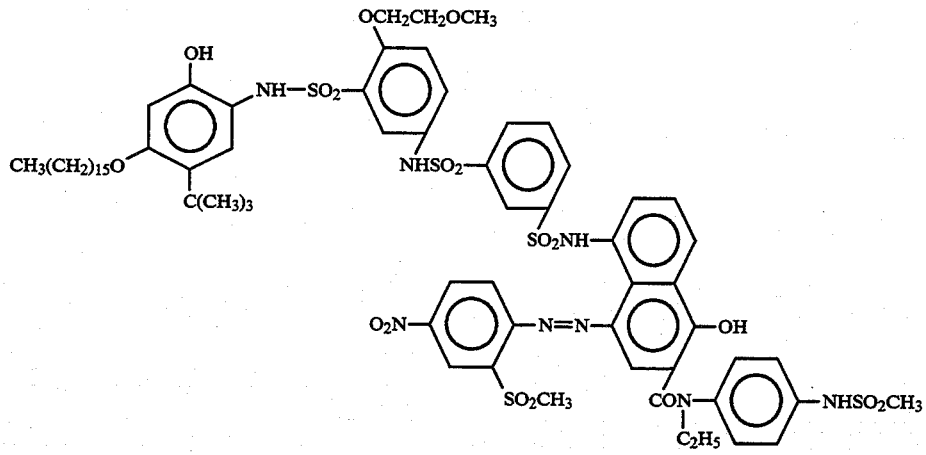

(2) A layer containing 0.5 g/m$^2$ of gelatin.

(3) A red-sensitive emulsion layer containing 0.6 g/m$^2$ (on a silver basis) of a red-sensitive direct-positive silver bromide emulsion of internal latent-image type, 1.2 g/m$^2$ of gelatin, 0.015 g/m$^2$ of the nucleating agent illustrated below, and 0.06 g/m$^2$ of sodium salt of 2-sulfo-5-n-pentadecylhydroquinone:

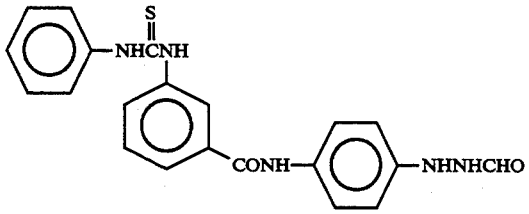

(4) A layer containing 0.43 g/m$^2$ of 2,5-di-t-pentadecylhydroquinone, 0.1 g/m$^2$ of trihexyl phosphate and 0.4 g/m$^2$ of gelatin.

(5) A layer containing 0.3 g/m$^2$ of the magenta dye-releasing redox compound illustrated below, 0.08 g/m$^2$ of tricyclohexyl phosphate, 0.009 g/m$^2$ of 2,5-d-t-pentadecylhydroquinone and 0.5 g/m$^2$ of gelatin:

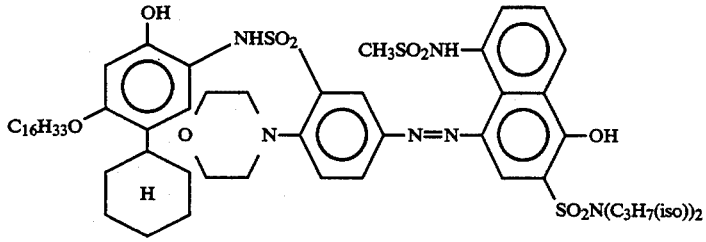

(6) A green-sensitive emulsion layer containing 0.42 g/m$^2$ (on a silver basis) of a green-sensitive direct-positive silver bromide emulsion of internal latent-image type, 0.9 g/m$^2$ of gelatin, 0.013 g/m$^2$ of the same nucleating agent as used in the layer (3), and 0.07 g/m$^2$ of sodium salt of 2-sulfo-5-n-pentadecylhydroquinone.

(7) The same layer as the layer (4).

(8) A layer containing 0.53 g/m$^2$ of the yellow dye-releasing redox compound illustrated below, 0.13 g/m$^2$ of tricyclohexyl phosphate, 0.014 g/m$^2$ of 2,5-di-t-pentadecylhydroquinone and 0.7 g/m$^2$ of gelatin:

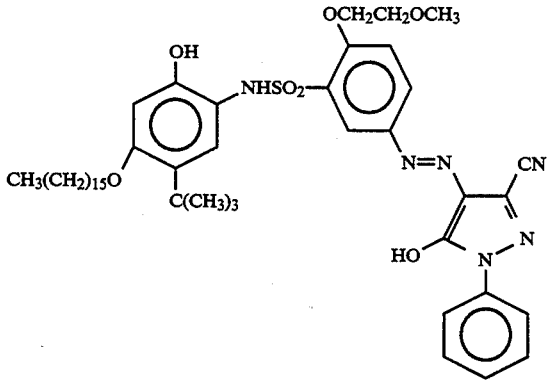

(9) A blue-sensitive emulsion layer containing 0.6 g/m$^2$ (on a silver basis) of a blue-sensitive direct-positive silver bromide emulsion of internal latent-image type, 1.1 g/m$^2$ of gelatin, 0.019 g/m$^2$ of the same nucleating agent as used in the layer (3), and 0.05 g/m$^2$ of sodium salt of 2-sulfo-5-n-pentadecylhydroquinone.

(10) A layer containing 1.0 g/m$^2$ of gelatin.

Photographic Elements 302 to 309 were prepared in the same manner as Photographic Element 301, except that a layer containing 1.0 g/m$^2$ of the compound of the present invention as set forth in Table F and 1.0 g/m$^2$ of gelatin was further provided between the support and the cyan dye-releasing layer.

Moreover, an image-receiving sheet (a dye-fixing element) having the layer structure described in Table E was prepared.

TABLE E

| Constitution of Image-Fixing Element: | | | |
|---|---|---|---|
| Number of Layer | Name of Layer | Ingredients | Coverage (g/m$^2$) |
| F 6th | Protective layer | Gelatin | 0.6 |
| F 5th | Mordanting layer | Gelatin | 3.0 |
| | | Mordant (A) | 3.0 |
| | | Coating aid (B) | 0.5 |
| F 4th | Timing layer (1) | Polymer latex (1)* | 0.96 |
| | | Polymer latex (2)** | 0.64 |
| F 3rd | Interlayer | Poly(2-hydroxyethyl-methacrylate) | 0.4 |
| F 2nd | Timing layer (2) | Cellulose acetate (acetylation degree: 51.3%) | 4.27 |
| | | Styrene-maleic anhydride (1:1 by mole) copolymer (average molecular weight: 10,000) | 0.23 |
| F 1st | Neutralizing layer | Acrylic acid-butylacrylate (8:2 by mole) copolymer (average molecular weight: 50,000) | 22 |

150 μm-thick Paper Support (laminated with

TABLE E-continued

| Number of Layer | Constitution of Image-Fixing Element: Name of Layer | Ingredients | Coverage ($g/m^2$) |
|---|---|---|---|
| | 30 μm-thick polyethylene film on both sides) | | |
| B 1st | Light-shielding layer | Gelatin | 2.0 |
| | | Carbon black | 4.0 |
| B 2nd | White layer | Gelatin | 1.0 |
| | | Titanium oxide | 8.0 |
| B 3rd | Protective layer | Gelatin | 0.6 |

Coating Aid (B)

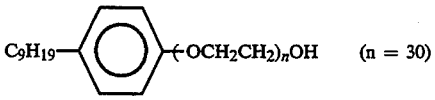

Mordant (A)

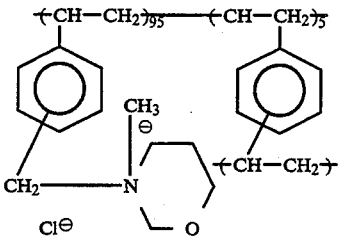

| Composition of Processing Solution: | |
|---|---|
| 2-p-Tolyl-4-hydroxymethyl-4-methyl-3-pyrazolidone | 6.9 g |
| Methylhydroquinone | 0.3 g |
| 5-Methylbenzotriazole | 3.5 g |
| Sodium sulfite (anhydrous) | 0.2 g |
| Sodium salt of carboxymethyl cellulose | 58 g |
| Potassium hydroxide (28% aq. soln.) | 200 ml |
| Benzyl alcohol | 1.5 ml |
| Water | 835 ml |

*Polymer Latex (1)
Styrene/butylacrylate/acrylic acid/N-methylol acrylamide (49.7/42.2/4/4 by weight) copolymer
**Polymer Latex (2)
Methylmethacrylate/acrylic acid/N-methylol acrylamide (93/3/4 by weight) copolymer Each of the foregoing photosensitive sheets was exposed imagewise, and then brought into a face-to-face contact with the foregoing image-receiving sheet. Thereafter, the foregoing processing solution was spread between those two sheets at 25° C. so as to form a thickness of 60 μm, thereby conducting photographic processing. Half of the image-receiving sheet was peeled apart from each photosensitive sheet after a 90-second lapse from the processing, and the other half was peeled apart therefrom after a 180-second lapse. These two halves were examined for their respective maximum densities (Dmax). The results obtained are shown in Table F.

As can be seen from Table F, the peel-apart time dependence of Dmax was markedly reduced by the use of the compounds of the present invention.

As described above, in accordance with embodiments of the present invention, the change in density with the lapse of time after the transfer processing can be remarkably suppressed without lowering the maximum density achievable just after the transfer processing.

While the invention has been described in detail and with reference to specific examples thereof, it will be apparent to one skilled in the art that various changes and modifications can be made therein without departing from the spirit and scope thereof.

What is claimed is:

1. A color diffusion transfer photosensitive material comprising at least one silver halide emulsion layer having associated therewith at least one dye image-forming substance and further comprising at least one compound represented by the following general formula (I):

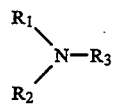

(I)

wherein $R_1$ and $R_2$ each represents an aliphatic group which may be unsubstituted or may be substituted by a carbamoyl group, an alkoxy group, an aryloxy group, an aryl group, a sulfonyl group, an acylamino group, an alkylamino group, or a heterocyclic group; and $R_3$ represents an aliphatic group or a group represented by the following general formula (Ab):

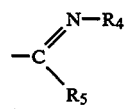

(Ab)

wherein $R_4$ represents a hydrogen atom, an aliphatic group or an aryl group and $R_5$ represents an aliphatic group, an aryl group or an amino group; and further, $R_1$ and $R_2$, $R_1$ and $R_3$, $R_2$ and $R_3$, or $R_4$ and $R_5$ may combine with each other to form a 5- to 7-membered ring, or $R_1$, $R_2$ and $R_3$ may combine with one another to form a bicyclo ring; wherein the total number of carbon atoms present in $R_1$, $R_2$ and $R_3$ is in the range of 20 to 80.

2. The color diffusion transfer photosensitive material of claim 1, wherein said material comprises: (A) a color diffusion transfer film unit comprising (i) a photosensitive sheet comprising a transparent support having thereon an image-receiving layer, a light-reflecting white layer, a light-shielding layer and at least one silver halide emulsion layer having associated therewith at

TABLE F

| Photographic Element | Compound Added | Peel-apart after 90 seconds DB | DG | DR | Peel-apart after 180 seconds DB | DG | DR | Note |
|---|---|---|---|---|---|---|---|---|
| 301 | — | 1.80 | 2.21 | 2.70 | 2.10 | 2.41 | 2.90 | comparison |
| 302 | (2) | 1.80 | 2.21 | 2.71 | 1.90 | 2.30 | 2.81 | invention |
| 303 | (3) | 1.80 | 2.20 | 2.71 | 1.91 | 2.26 | 2.78 | invention |
| 304 | (5) | 1.81 | 2.19 | 2.70 | 1.90 | 2.27 | 2.78 | invention |
| 305 | (10) | 1.81 | 2.19 | 2.68 | 1.91 | 2.29 | 2.80 | invention |
| 306 | (12) | 1.80 | 2.21 | 2.69 | 1.90 | 2.27 | 2.81 | invention |
| 307 | (16) | 1.78 | 2.20 | 2.68 | 1.92 | 2.30 | 2.77 | invention |
| 308 | (18) | 1.80 | 2.21 | 2.70 | 1.90 | 2.29 | 2.78 | invention |
| 309 | (24) | 1.81 | 2.19 | 2.71 | 1.91 | 2.30 | 2.78 | invention |

least one dye image-forming substance, (ii) a transparent cover sheet comprising a transparent support having thereon at least a neutralizing layer and a neutralization timing layer, and (iii) a light-shielding alkaline processing composition arranged so as to be spread between the foregoing photosensitive and transparent cover sheets: or (B) a color diffusion transfer film unit comprising (i) an image-receiving sheet comprising a support having thereon, in sequence, a neutralizing layer, a neutralization timing layer, an image-receiving layer and a releasable layer, (ii) a photosensitive sheet comprising a support provided with a light-shielding layer having thereon at least one silver halide emulsion layer having associated therewith at least one dye image-forming substance, and (iii) an alkaline processing composition to be spread between the foregoing image-receiving and photosensitive sheets.

3. The color diffusion transfer photosensitive material of claim 1, wherein the amount of the compound represented by formula (I) is 0.3 to 10 $g/m_2$.

4. The color diffusion transfer photosensitive material of claim 3, wherein the amount of the compound represented by formula (I) is 0.5 to 5 $g/m^2$.

* * * * *